US005167114A

United States Patent [19]

Stahlecker

[11] Patent Number: 5,167,114

[45] Date of Patent: * Dec. 1, 1992

[54] ARRANGEMENT FOR PRODUCING SPOOL PACKAGES USED AS FEEDING PACKAGES FOR TWISTING

[75] Inventor: Fritz Stahlecker, Bad Überkingen, Fed. Rep. of Germany

[73] Assignee: Hans Stahlecker, Fed. Rep. of Germany; a part interest

[ * ] Notice: The portion of the term of this patent subsequent to Jul. 31, 2007 has been disclaimed.

[21] Appl. No.: 470,799

[22] Filed: Jan. 26, 1990

[30] Foreign Application Priority Data

Jan. 28, 1989 [DE] Fed. Rep. of Germany ..... 3902548

[51] Int. Cl.[5] ..... D01H 1/20; D01H 1/115

[52] U.S. Cl. ..... 57/261; 57/80; 57/264; 57/278; 57/328

[58] Field of Search ..... 57/261, 264, 328, 332, 57/333, 80, 81, 269, 270–272, 278–279, 353, 281

[56] References Cited

U.S. PATENT DOCUMENTS

| | | | |
|---|---|---|---|
| 4,112,665 | 8/1978 | Werst | 57/261 X |
| 4,123,893 | 11/1978 | Chablel et al. | 57/333 X |
| 4,219,998 | 8/1980 | Farnhill | 57/333 |
| 4,656,822 | 4/1987 | Meissner et al. | 57/264 X |
| 4,683,711 | 8/1987 | Glock | 57/80 X |
| 4,790,130 | 12/1988 | Stahlecker et al. | 57/261 |
| 4,819,419 | 4/1989 | Stahlecker et al. | 57/261 |
| 4,845,936 | 7/1989 | Artzt et al. | 57/261 |
| 4,893,461 | 1/1990 | Artzt et al. | 57/261 |
| 4,944,145 | 7/1990 | Stahlecker | 57/81 |
| 4,947,633 | 8/1990 | Stahlecker | 57/328 X |
| 4,964,268 | 10/1990 | Stahlecker | 57/350 X |
| 4,995,229 | 2/1991 | Stahlecker | 57/261 |
| 5,005,348 | 4/1991 | Stahlecker | 57/328 X |
| 5,016,432 | 5/1991 | Stahlecker | 57/328 X |
| 5,044,150 | 9/1991 | Stahlecker | 57/328 |

FOREIGN PATENT DOCUMENTS

| | | | |
|---|---|---|---|
| 2339654 | 2/1975 | Fed. Rep. of Germany . | |
| 3634464 | 4/1988 | Fed. Rep. of Germany | 57/261 |
| 3800810 | 8/1988 | Fed. Rep. of Germany . | |
| 3802413 | 8/1989 | Fed. Rep. of Germany | 57/261 |
| 3817493 | 11/1989 | Fed. Rep. of Germany | 57/261 |
| 3828323 | 2/1990 | Fed. Rep. of Germany | 57/261 |

*Primary Examiner*—Daniel P. Stodola
*Assistant Examiner*—William Stryjewski
*Attorney, Agent, or Firm*—Evenson, Wands, Edwards, Lenahan & McKeown

[57] ABSTRACT

An arrangement for producing spool packages serving as feeding packages for twisting, having a control apparatus for interrupting the operation. Sliver detectors arranged in front of drafting units are connected to the control apparatus. At least one yarn detector is connected which is arranged behind air nozzles. It is provided that the control apparatus is equipped with devices for generating a piecing signal, the piecing signal being generated after the yarn detector or detectors has/have responded or, if a sliver detector has responded, after the defect signal of the sliver detector is extinguished.

22 Claims, 2 Drawing Sheets

ARRANGEMENT FOR PRODUCING SPOOL PACKAGES USED AS FEEDING PACKAGES FOR TWISTING

BACKGROUND AND SUMMARY OF THE INVENTION

The invention relates to an arrangement for producing package spools used as feeding packages for twisting onto which two yarns are wound side by side, having drafting units for two slivers, having air nozzles for strengthening the slivers to form yarn components, and having yarn guides for the guiding-together of the yarn components to form a double yarn. A withdrawal device is provided for withdrawing the double yarn which has a wind-up device for winding the double yarn onto a package spool. A control apparatus is also Provided for interrupting the operation, with sliver detectors connected arranged in front of the drafting units and with at least one yarn detector connected arranged behind the air nozzles.

Arrangements of the initially mentioned type are known (DE-A 36 34 464—corresponding U.S. application Ser. No. 105,813, filed Oct. 8, 1987, now U.S. Pat. No. 4,790,130 and DE-A 38 00 810). If one or both slivers to be fed should break in these arrangements, this sliver breakage must be eliminated first, for example, by connecting with a newly fed sliver, before a piecing operation can be carried out.

It is also known to monitor the individual yarn components with respect to thick and thin points and to clean these out before the yarn components are guided together to form a double yarn. After the cleaning-out, a new piecing must also be carried out.

In the case of ring spinning machines, it is known (DE-A 23 39 654) to equip an automatic piecing apparatus with a device at the outlet of the drafting unit which determines whether roving is supplied at the spinning point at which a yarn breakage is to be eliminated. If no roving is present, no piecing operation is initiated. Since the emerging of roving, which is not spun into a yarn, from the drafting unit is also an indication of a yarn breakage, this signal is at the same time used as a piecing signal, i.e., as the signal which triggers the start of the operation of the piecing device.

An object of the invention is to develop an arrangement of the initially mentioned type so that it is suitable for an automatic device and so that an automatic piecing carriage can be called to the respective arrangement, as required.

This object is achieved in that the control apparatus is equipped with devices for generating a piecing signal, the piecing signal being generated after the yarn detector or detectors has/have responded or, if a sliver detector has responded, after the defect signal of the sliver detector is extinguished.

By means of this construction, it is taken into account that a piecing cannot be carried out if one or both slivers moving into the drafting units is or are broken. In this case, a piecing device does not become operative at the respective arrangement as long as the sliver breakage is not eliminated and the defect signal of the sliver detector is not extinguished. It is only when a successful piecing operation is possible that the automatic piecing carriage receives a corresponding signal so that it becomes operative.

As a rule, there will only be a sliver breakage when the sliver which is taken from a can for example, is used up. In order to draw the attention of the operator or of an automatic can changing device with an automatic sliver piecing device to this defect, it is provided in a further development of preferred embodiments of the invention that the control apparatus is equipped with devices for generating a signal which indicates a sliver defect.

In a further development of preferred embodiments of the invention, it is provided that the control apparatus is equipped with devices for the switching-on of the drafting unit which can be switched on for a given time period after the extinguishing of a signal of a sliver detector indicating a sliver defect, and that the control apparatus is connected with devices for the simultaneous activating of suction devices assigned to the outlet of the drafting units. As a result, it is ensured that the part of the sliver to which the new sliver was pieced and which represents a thick point, in most cases, is not used for producing a yarn component. The reason is that there is the risk that this thick point may result in a yarn defect which would be detected by a corresponding yarn detector and would lead to a switching-off of the corresponding spinning arrangement for the cleaning-out of this yarn defect. In this case, the piecing operation would have to be repeated within a very short time at the same spinning arrangement. However, this cannot happen before the piecing carriage, when carrying out its monitoring travel, passes by again at the respective arrangement. In the case of a large machine, this may result in a disadvantageously long stoppage time.

Other objects, advantages and novel features of the present invention will become apparent from the following detailed description of the invention when considered in conjunction with the accompanying drawings.

DETAILED DESCRIPTION OF THE INVENTION

Figure 1:
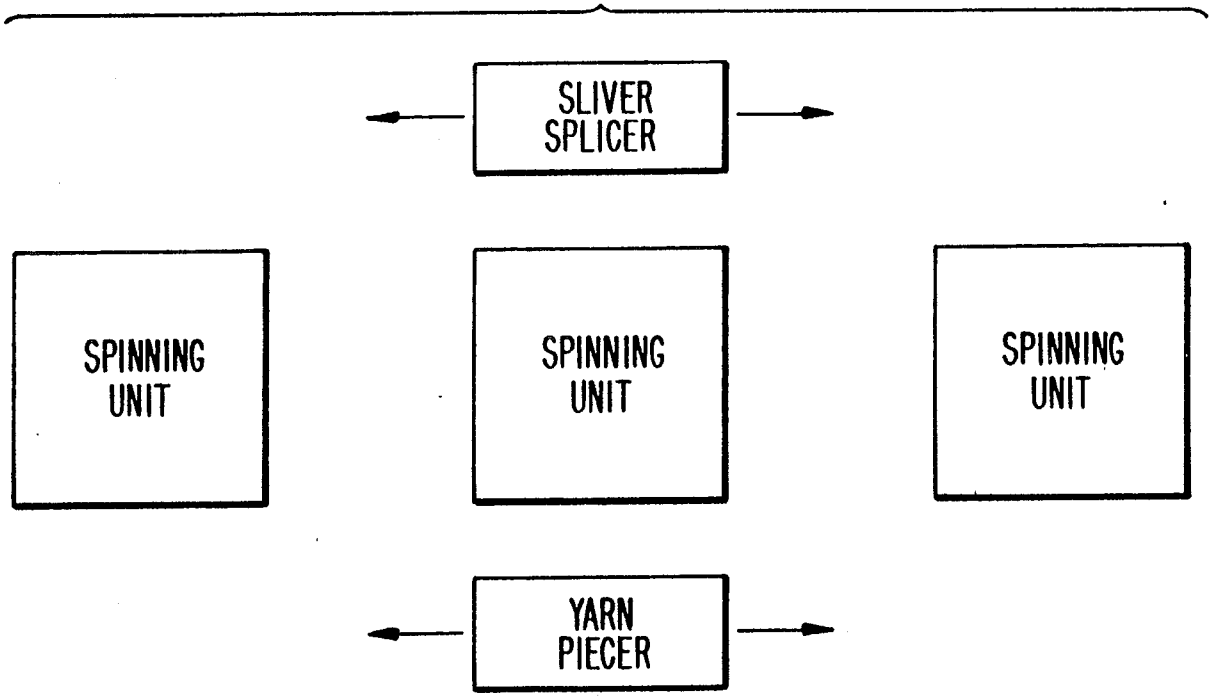
FIG. 1 is a schematic top view of a spinning machine utilizing the present invention.
Figure 2:
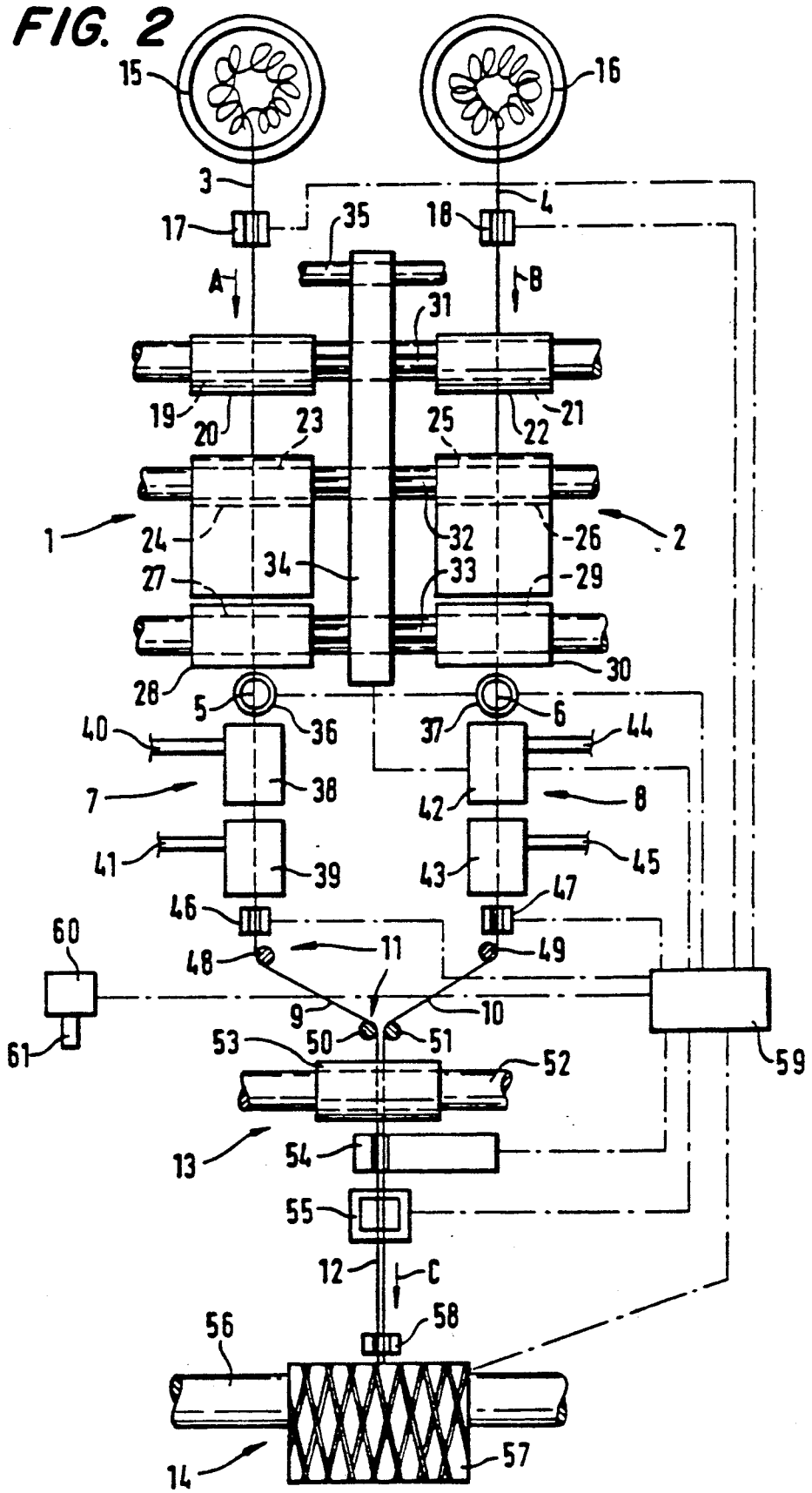
FIG. 2 is a schematic view of an individual spinning unit of the machine of FIG. 1, constructed according to a preferred embodiment of the invention.

The spinning arrangement contains two drafting units 1, 2, which are combined into a double aggregate. Slivers 3, 4 enter into the drafting units 1, 2 and are drawn to a desired yarn count in the drafting units. The drawn yarn components 5, 6, which leave the drafting units 1, 2, enter into pneumatic false-twisting devices 7, 8. In these pneumatic false-twisting devices 7, 8, they are prestrengthened in a known manner to such an extent that they can be temporarily wound up for a later operation.

The two prestrengthened yarn components 9, 10 which leave the false-twisting devices 7, 8, are combined to a double yarn 12 by means of yarn guides 11. The double yarn 12 is withdrawn by means of a withdrawal device 13 and then moves in the direction of the arrow (C) to a wind-up device 14 by which the double yarn 12 is wound up side by side onto a package spool 57.

The slivers 3, 4 are fed from cans 15, 16 which are placed on the rearward side of the machine. The drafting units 1, 2, the false-twisting device 7, 8, the withdrawal device 13 and the wind-up device 14, on the other hand, are located on the front side of the machine.

In the shown embodiment, the drafting units 1, 2 are constructed as so-called three-cylinder drafting units. They each have three top rollers 20, 22; 24, 26; 28, 30 to which the bottom rollers 19, 21; 23, 25; 27, 29 are assigned. The top rollers 20, 22; 24, 26; 28, 30 are each held in a common bearing arm 34 by means of common shafts 31, 32, 33. For the opening of the drafting units 1, 2, this bearing arm 34 can be swivelled around a holding rd 35 extending in the longitudinal direction of the machine. The bottom rollers 19, 21; 23, 25; 27, 29 are constructed as cylinders which extend through in the longitudinal direction of the machine and are driven at the machine end. As indicated in the drawing, apron drafting units are provided in the main drafting zone.

Instead of the shown drafting units 1, 2, a drafting unit aggregate may be provided according to another contemplated embodiment in which the adjacent drafting units, corresponding to drafting units 1, 2, consist of shaft sections which can be stopped individually.

The pneumatic false-twisting devices 7, 8 each contain two air nozzles 38, 39; 42, 43 arranged behind one another which are connected to a compressed-air source by means of pipes 40, 41, 44, 45. The respectively first air nozzles 38, 42 are constructed as so-called intake nozzles, while the air nozzles 39, 43 which follow are constructed as false-twisting nozzles. By means of these pneumatic false-twisting devices 7, 8, a false twist is generated in the yarn components 5, 6, which extends to the drafting units 1, 2 and which disappears when leaving the false-twisting nozzles 39, 43. However, fiber ends at the surface remain wound around the fiber core consisting essentially of parallel fibers and provide the yarn components 5, 6 with a certain strength.

The yarn guides 11 consist of rod-shaped yarn guides 48, 49 and additional yarn guides 50, 51 which guide the two yarn components 9, 10 together, in which case they define the remaining narrow distance of the yarn components 5, 6 in the double yarn 12.

The withdrawal device 13 consists of a driven bottom cylinder 52 extending through in the longitudinal direction of the machine and of a pressure roller 53.

Of the wind-up device 14, only one wind-up roller 56 is shown which extends through in the longitudinal direction of the machine and is driven at the machine end, the spool package 57 resting on this wind-up roller 56 during the wind-up operation. Devices for holding the spool package 57 are also part of the wind-up device 14. The wind-up device 14 also has a cross-winding device 58 which is only outlined in the drawing.

Sliver detectors 17, 18 are arranged in front of the drafting units 1, 2 which monitor the presence of the slivers 3, 4. Yarn detectors 46, 47 are arranged directly behind the false-twisting devices 7, 8. Another yarn detector 54 is arranged behind the withdrawal device 13 and monitors the double yarn 12 with respect to unacceptable thick points or thin points. A yarn intake nozzle 55 is also arranged in front of the wind-up device 14.

The sliver detectors 17, 18 as well as the yarn detectors 46, 47 and 54 are connected to a control apparatus, as shown by dash-dotted lines. This control apparatus 59 is connected with a device which is not shown, such as a pneumatic or hydraulic press, by means of which the bearing arm 34 of the drafting units 1, 2 can be lifted; i.e., by means of which the operation of the drafting units 1, 2 can be interrupted. As also shown by a dash-dotted line, the control apparatus 59 is connected with a yarn suction device 55, i.e., with a valve assigned to this suction device. As shown by means of another dash-dotted line, the control apparatus 59 is also connected with the wind-up device 14, i.e., with an actuating element, such as also a pneumatic or hydraulic press by means of which the package spool 57 can be lifted off for interrupting the wind-up operation of the wind-up roller 56.

This interrupting of the operation of the arrangement takes place as soon as the sliver detectors 17, 18 or the yarn detectors 46, 47 report a breakage, or the yarn detector 54 reports an unacceptable quality defect. Subsequently, a piecing operation takes place by means of an automatic piecing carriage which is not shown, which travels along the front side of the spinning machine and which, in each case, can be applied to an individual spinning arrangement for the carrying-out of a piecing operation.

The control apparatus 59 is connected with a signal generator 60 at which a piecing signal is set if the piecing carriage is to stop at the corresponding spinning arrangement. This piecing signal is set if one of the yarn detectors 46, 47 or 54 is addressed and subsequently a piecing operation is required. However, since the same piecing carriage cannot check the sliver supply from the cans 15, 16 on the rearward side of the machine, it is provided that, when one or both sliver(s) 3, 4 break(s), which is indicated by the sliver detectors 17, 18, a corresponding signal is set by the control apparatus 59 which indicates the sliver breakage, such as an additional signal 61 in the form of a button or the like, which can be moved out, at the signal generator 60. This signal indicates to the piecing carriage that, despite the stoppage, it must not carry out any piecing operation. It is only after the sliver breakage is eliminated, for example, by the making-available of new cans 15, 16 and by connecting the slivers 3, 4 with the start of the newly supplied slivers, for example, by splicing, that the signal indicating the sliver breakage is reset. It is only then that the piecing signal becomes operative so that the piecing carriage starts its operation.

Also if the new sliver is connected with the end of the old sliver by means of splicing, as a rule, a thick point cannot be avoided which, under certain circumstances, may result in such a defect that the yarn detector 54 will response. In order to prevent that this thick point enters the wound-up double yarn at all, it is provided in a further development of the invention that, after the resetting of the "sliver breakage" signal, the control apparatus 59, by way of the pertaining actuating device, shuts down the drafting units 1, 2 for a given time period and, at the same time, activates the suction nozzles 36, 37 located at the outlet of the drafting units 1, 2. In this case, it may be provided that these suction devices 36, 37 are applied only during a yarn breakage. The fiber material which, during this time period, moves through the drafting unit 1, 2, is therefore sucked off and removed without entering into the double yarn.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed:

1. Apparatus for producing feeding packages containing two yarns wound up side-by-side for a subsequent twisting operation, comprising at least one double yarn producing unit including:

drafting means for drafting two slivers;

prestrengthening means arranged downstream of said drafting means and including means to form two separate prestrengthened yarn components from the respective slivers, yarn guide means for guiding the yarn components together to form a double yarn with said yarn components disposed in side-by-side relationship, withdrawing means for withdrawing the double yarn from the yarn guide means, and winding means for winding the double yarn supplied by the withdrawing means onto a spool package, piecing means for piecing previously formed prestrengthened double yarn components with respective prestrengthened double yarn components being formed by the prestrengthening means at a respective double yarn producing unit, sliver monitoring means disposed upstream of the prestrengthening means at a respective double yarn producing unit for monitoring slivers being drafted by the drafting means and for generating signals indicating whether one or both slivers are present and of an acceptable quality without defects that would jeopardize successful subsequent piecing operations, and control means for controlling operation of the piecing means such that piecing is only carried out at a respective double yarn producing unit in the event the sliver monitoring means indicates the presence of both slivers of an acceptable quality.

2. Apparatus according to claim 1, further comprising yarn component monitoring means disposed downstream of the prestrengthening means at a respective double yarn producing unit for monitoring yarn components formed by the prestrengthening means and for generating signals indicating whether one or both yarn components are broken or of an unacceptable quality, wherein said control means for controlling operation of the piecing means includes means for initiating piecing in response to said signal from the yarn component monitoring means indicative of breakage or unacceptable quality of at least one of the two yarn components when said sliver monitoring means also indicates the presence of both slivers of an acceptable quality.

3. Apparatus according to claim 2, further comprising sliver supply means for supplying a new sliver at the drafting means at respective double yarn producing unit in response to said sliver monitoring means generating signals indicating absence of or unacceptable quality of at least one of said slivers.

4. Apparatus according to claim 3, wherein a plurality of said double yarn producing units are provided, and wherein said piecing means includes a mobile piecing unit which is selectively positioned adjacent respective ones of the yarn producing units to perform piecing operations.

5. Apparatus according to claim 4, wherein a plurality of said double yarn producing units are provided, wherein said sliver supply means includes a mobile sliver splicing unit which is selectively positioned adjacent respective ones of the yarn producing units to perform sliver splicing operations.

6. Apparatus according to claim 5, wherein said sliver supply means includes means for stopping the drafting means for a predetermined time period after a sliver splicing operation and for simultaneously activating suction devices at the outlet of the drafting means to thereby remove thick sliver splicing points preliminary to subsequent piecing by the piecing means at a respective double yarn producing unit.

7. Apparatus according to claim 5, wherein said prestrengthening means includes pneumatic false twist nozzle means.

8. Apparatus according to claim 4, wherein a plurality of said double yarn producing units are provided, wherein said sliver supply means includes a mobile sliver splicing unit which is selectively positioned adjacent respective ones of the yarn producing units to perform sliver splicing operations.

9. Apparatus according to claim 4, wherein said sliver supply means includes means for stopping the drafting means for a predetermined time period after a sliver splicing operation and for simultaneously activating suction devices at the outlet of the drafting means to thereby remove thick sliver splicing points preliminary to subsequent piecing by the piecing means at a respective double yarn producing unit.

10. Apparatus according to claim 3, wherein the yarn component monitoring means includes two single-yarn component detectors arranged directly behind the respective prestrengthening means.

11. Apparatus according to claim 3, wherein the yarn component monitoring means includes a double yarn detector arranged between the yarn guide means and the winding means.

12. Apparatus according to claim 3, wherein said sliver supply means includes means for stopping the drafting means for a predetermined time period after a sliver splicing operation and for simultaneously activating suction devices at the outlet of the drafting means to thereby remove thick sliver splicing points preliminary to subsequent piecing by the piecing means at a respective double yarn producing unit.

13. Apparatus according to claim 2, wherein a plurality of said double yarn producing units are provided, and wherein said piecing means includes a mobile piecing unit which is selectively positioned adjacent respective ones of the yarn producing units to perform piecing operations.

14. Apparatus according to claim 2, wherein the yarn component monitoring means includes two single-yarn component detectors arranged directly behind the respective prestrengthening means.

15. Apparatus according to claim 2, wherein the yarn component monitoring means includes a double yarn detector arranged between the yarn guide means and the winding means.

16. Apparatus according to claim 2, wherein said prestrengthening means includes pneumatic false twist nozzle means.

17. Apparatus according to claim 1, further comprising sliver supply means for supplying new sliver at the drafting means at a respective double yarn producing unit in response to said sliver monitoring means generating signals indicating absence of or unacceptable quality of at least one of said slivers.

18. Apparatus according to claim 17, wherein said sliver supply means includes means for stopping the drafting means for a predetermined time period after a sliver splicing operation and for simultaneously activating suction devices at the outlet of the drafting means to thereby remove thick sliver splicing points preliminary to subsequent piecing by the piecing means at a respective double yarn producing unit.

19. Apparatus according to claim 17, wherein said prestrengthening means includes pneumatic false twist nozzle means.

20. Apparatus according to claim 1, wherein a plurality of said double yarn producing units are provided, and wherein said piecing means includes a mobile piecing unit which is selectively positioned adjacent respective ones of the yarn producing units to perform piecing operations.

21. Apparatus according to claim 20, wherein said prestrengthening means includes pneumatic false twist nozzle means.

22. Apparatus according to claim 1, wherein said prestrengthening means includes pneumatic false twist nozzle means.

* * * * *